US012607399B2

(12) United States Patent
Prosser

(10) Patent No.: US 12,607,399 B2
(45) Date of Patent: Apr. 21, 2026

(54) LIQUID NITROGEN ENERGY STORAGE SYSTEM

(71) Applicant: Neil M. Prosser, Lockport, NY (US)

(72) Inventor: Neil M. Prosser, Lockport, NY (US)

(73) Assignee: Praxair Technology, Inc., Danbury, CT (US)

( * ) Notice: Subject to any disclaimer, the term of this patent is extended or adjusted under 35 U.S.C. 154(b) by 492 days.

(21) Appl. No.: 18/307,452

(22) Filed: Apr. 26, 2023

(65) Prior Publication Data

US 2023/0408188 A1 Dec. 21, 2023

Related U.S. Application Data

(60) Provisional application No. 63/352,852, filed on Jun. 16, 2022.

(51) Int. Cl.
*F25J 1/00* (2006.01)

(52) U.S. Cl.
CPC ..... *F25J 1/0035* (2013.01); *F25J 1/0015* (2013.01); *F25J 1/0045* (2013.01); *F25J 2270/04* (2013.01)

(58) Field of Classification Search
CPC ..... F25J 1/0202; F25J 1/0288; F25J 1/0228; F25J 1/0042; F25J 1/0015; F25J 1/0274; F25J 1/0251; F25J 1/0264; F25J 1/0234; F25J 1/0035; F25J 1/0037; F25J 1/0045; F25J 2240/44; F25J 2240/90; F25J 2270/04; F25J 2270/06
See application file for complete search history.

(56) References Cited

U.S. PATENT DOCUMENTS

| | | | | |
|---|---|---|---|---|
| 4,778,497 | A | 10/1988 | Hanson et al. | |
| 5,141,543 | A * | 8/1992 | Agrawal | F25J 3/04224 62/612 |
| 5,231,835 | A | 8/1993 | Beddome et al. | |
| 6,220,053 | B1 | 4/2001 | Hass, Jr. et al. | |
| 11,346,602 | B2 * | 5/2022 | Prosser | F25J 1/0294 |
| 2011/0308275 | A1 * | 12/2011 | Xu | F25J 1/0042 62/615 |
| 2013/0118204 | A1 * | 5/2013 | Higginbotham | F25J 1/0022 62/615 |
| 2014/0245756 | A1 * | 9/2014 | Morgan | F25J 1/0035 62/50.1 |

(Continued)

*Primary Examiner* — Frantz F Jules
*Assistant Examiner* — Webeshet Mengesha
(74) *Attorney, Agent, or Firm* — Robert J. Hampsch

(57) ABSTRACT

A liquid nitrogen energy storage (LNES) system that includes a liquid charging mode and a power generating mode is provided. The disclosed liquid nitrogen energy storage system comprises a nitrogen liquefier designed to cool or liquefy a first portion of the gaseous nitrogen and a cold recovery heat exchanger designed to cool or liquefy a second portion of the gaseous nitrogen during a liquid charging mode and to warm a liquid nitrogen energy stream during a power generating mode. The liquid nitrogen energy storage system also includes a cold store configured to provide refrigeration for liquefaction of the second portion of the gaseous nitrogen in the cold recovery heat exchanger during the liquid charging mode and to warm a portion of the liquid nitrogen taken as a liquid nitrogen energy stream in the cold recovery heat exchanger during the power generating mode.

6 Claims, 5 Drawing Sheets

(56) References Cited

U.S. PATENT DOCUMENTS

| | | | | |
|---|---|---|---|---|
| 2015/0192065 | A1* | 7/2015 | Alekseev | F25J 1/0228 60/407 |
| 2015/0192330 | A1 | 7/2015 | Alekseev | |
| 2016/0160694 | A1* | 6/2016 | Alekseev | F25J 1/0202 60/671 |
| 2017/0022897 | A1 | 1/2017 | Alekseev et al. | |

* cited by examiner

LIQUID NITROGEN ENERGY STORAGE SYSTEM

CROSS REFERENCE TO RELATED APPLICATIONS

This application claims the benefit of and priority to U.S. provisional patent application Ser. No. 63/352,852 filed Jun. 16, 2022 the disclosure of which is incorporated by reference.

TECHNICAL FIELD

The present invention relates generally to energy storage systems, and more particularly, to a liquid nitrogen energy storage system.

BACKGROUND

There is a continuing need to develop and demonstrate new energy storage systems and technologies that are both technically feasible and commercially viable. Per various U.S. Department of Energy (DOE) solicitations, such energy storage systems and technologies should have the capacity to discharge energy for a duration of greater than 10 hours at rated power and at a levelized cost of storage of about $0.05/kWh-cycle at some point in the near future. In addition, the targeted energy storage systems should be at a mega-watt scale.

The U.S. DOE requirements or specifications further desire that the new energy storage systems and technologies be long duration storage systems able to supply power for weekly or monthly durations and have the capacity to continuously discharge energy on a daily or diurnal cycle for a range of 10 hours to 100 hours or more.

More specifically, DOE is considering evaluating technologies for use on a daily, diurnal cycle. A common scenario that exists in the United States is that of heavy late afternoon and evening (e.g. 3 pm-11 pm) energy use corresponding to a large proportion of the population returning home from work, with coincident high electricity use. This also corresponds to a time period when solar energy generation dissipates, so the non-renewable grid demand can increase greatly.

Alternatively, the new energy storage systems and technologies should be capable of addressing seasonal variations in local energy supply and energy demand. Changes in demand and generation over periods of months will yield the need for very long duration storage. On the demand side, this will arise from the marked seasonal changes in building heating, cooling, and lighting. On the supply side, there are large seasonal changes in renewable power generation. Solar energy decreases and increases based on seasonal daily sunshine. Wind energy also has seasonal variations over most of the globe.

Liquid air energy storage (LAES) is a known technology that is well suited for longer duration, and greater power generation magnitude than can be achieved economically with lithium-ion batteries. Unlike lithium-ion batteries, increasing energy duration or energy generation magnitude scales gradually for LAES. Whereas lithium-ion batteries require that a large component of their cost stack increase in direct proportion to their duration and generation magnitude, the LAES equipment simply becomes larger, with much less need for multiplication. Hence, increased duration and generation magnitude of LAES based systems and technologies will scale to an exponent closer to 0.6 while lithium-ion battery based systems and technologies will scale to and exponent approaching 1.0.

Unlike lithium-ion battery based energy storage systems, LAES based systems typically uses equipment with long lifetimes. The equipment is generally identical to that used in the industrial gas industry where such equipment lifetimes of 30 years or more is expected. With appropriate maintenance, current air separation plants are successfully operated today that were commissioned over 50 years ago. Also, the issue of managing loss of lithium-ion battery effectiveness and dealing with the expense and environmental issues relating to recycling materials in lithium-ion batteries is eliminated. In addition, LAES systems directly use and generate AC power. The large cost adder, and the efficiency penalty for the AC/DC rectification and DC/AC inverter required by lithium-ion battery based systems is avoided.

Unfortunately, the cost of LAES systems is relatively high and thus a barrier to widespread adoption and use in the long duration energy storage market. Unlike most other technologies LAES based systems often require mostly discrete and separate equipment for the charging step and the generating step, which represent a fundamental problem. To realize widespread adoption of LAES based systems, there must be a significant cost reduction of the LAES equipment which is viewed as unlikely.

SUMMARY

The present liquid nitrogen energy storage system may be broadly characterized as comprising: (a) a source of gaseous nitrogen; (b) a nitrogen liquefier comprising a nitrogen feed compressor; a nitrogen recycle compressor; one or more expanders, and a heat exchanger, the nitrogen liquefier configured to liquefy a first portion of the gaseous nitrogen; (c) a cold recovery heat exchanger configured to cool or liquefy a second portion of the gaseous nitrogen and to warm a liquid nitrogen energy stream; (d) one or more liquid nitrogen storage tanks configured to receive a liquid nitrogen streams from the nitrogen liquefier and the cold recovery heat exchanger; (e) a cold store configured to provide refrigeration for cool or liquefy the second portion of the gaseous nitrogen in the cold recovery heat exchanger and to warm the liquid nitrogen energy stream in the cold recovery heat exchanger; and (f) a nitrogen power expander arrangement configured to expand the warmed nitrogen energy stream and convert the work from the expansion of the nitrogen energy stream into power. The one or more liquid nitrogen storage tanks are further configured to release a liquid nitrogen product stream and a release the liquid nitrogen energy stream.

As used herein, the term 'liquefy' includes cooling a stream that is of supercritical pressure with the resulting 'liquid' stream alternatively referred to as a dense phase fluid. This dense phase fluid, if let down to a subcritical pressure is primarily liquid.

In embodiments where the second portion of the gaseous nitrogen stream is merely cooled instead of liquefied, a recirculating blower is disposed between the liquefaction heat exchanger and the cold recovery heat exchanger. The recirculating blower is configured to recirculate the cold nitrogen gas through one or more heat exchange passages in the cold recovery heat exchanger and one or more heat exchange passages in the liquefaction heat exchanger;

In some embodiments, the cold store further comprises one or more refrigerant vessels in flow communication with one or more heat exchange passages in the cold recovery heat exchanger and one or more refrigerants configured to flow between the one or more refrigerant vessels and the one or more heat exchange passages in the cold recovery heat exchanger. In other embodiments, the cold store further comprises a cold store solid media; and a recirculating nitrogen gas flow configured to flow between the cold store solid media and one or more heat exchange passages in the cold recovery heat exchanger.

The invention may also be characterized as a method of producing power and a liquid nitrogen product with a liquid nitrogen energy storage system comprising the steps of: (i) providing a gaseous nitrogen feed stream to the liquid nitrogen energy storage system; (ii) liquefying a first portion of the gaseous feed nitrogen stream in a nitrogen liquefier to yield a liquid nitrogen stream; (iii) directing the liquid nitrogen stream to one or more liquid nitrogen storage tanks; (iv) cooling a second portion of the gaseous nitrogen feed stream in a cold recovery heat exchanger via indirect heat exchange with one or more cold store refrigerants to yield a cold nitrogen stream while operating the liquid nitrogen energy storage system in a liquid charging mode; (v) directing a portion of the liquid nitrogen from the one or more liquid nitrogen storage tanks to the cold recovery heat exchanger as a liquid nitrogen energy stream; (vi) warming the liquid nitrogen energy stream in the cold recovery heat exchanger via indirect heat exchange with the one or more cold store refrigerants to yield a nitrogen energy stream while operating the liquid nitrogen energy storage system in a power generating mode; (vii) expanding the warmed nitrogen energy stream in a nitrogen expander and converting the work from the expansion of the nitrogen energy stream into power; and (viii) optionally withdrawing a liquid nitrogen product stream. The liquid nitrogen energy storage system is further configured to switch between operating in the liquid charging mode and operating in the power generating mode.

BRIEF DESCRIPTION OF THE DRAWINGS

The above and other aspects, features, and advantages of certain embodiments of the present disclosure will be more apparent from the following detailed description taken in conjunction with the following drawings in which.

DETAILED DESCRIPTION

An alternative energy storage solution is a variation of LAES that would be characterized as liquid nitrogen energy storage (LNES). In LNES based systems the equipment for producing and storing the liquid cryogen for subsequent power generation is the same equipment that is used to produce liquid nitrogen as a commercial product. Thus one could realize a significant cost reduction of the LNES equipment compared to the discrete and separate LAES equipment for the charging and the generating steps.

When comparing a LAES system to an LNES system, about 50% of the total energy storage equipment cost for LAES is employed to make liquid nitrogen as a product. But a portion of this liquid nitrogen serves as the cryogen for energy storage instead of liquid air. This means that most of the capital cost to produce liquid nitrogen is borne by its use as a standalone commercial product and the total capital cost for a LNES system can approach 50% of that of LAES system.

Initial estimates of capital and operating expenses indicate that the levelized cost of storage with an advantaged LNES system can achieve $0.05/kWh-cycle for large scale commercial projects. In addition to the substantial cost advantage a LNES system provides over LAES, existing liquid nitrogen production assets already deployed at various locations may be leveraged for use in future LNES commercial projects. That is, unlike LAES systems, the assets of an existing nitrogen liquefier unit can facilitate energy storage implementation for LNES.

Figure 1:
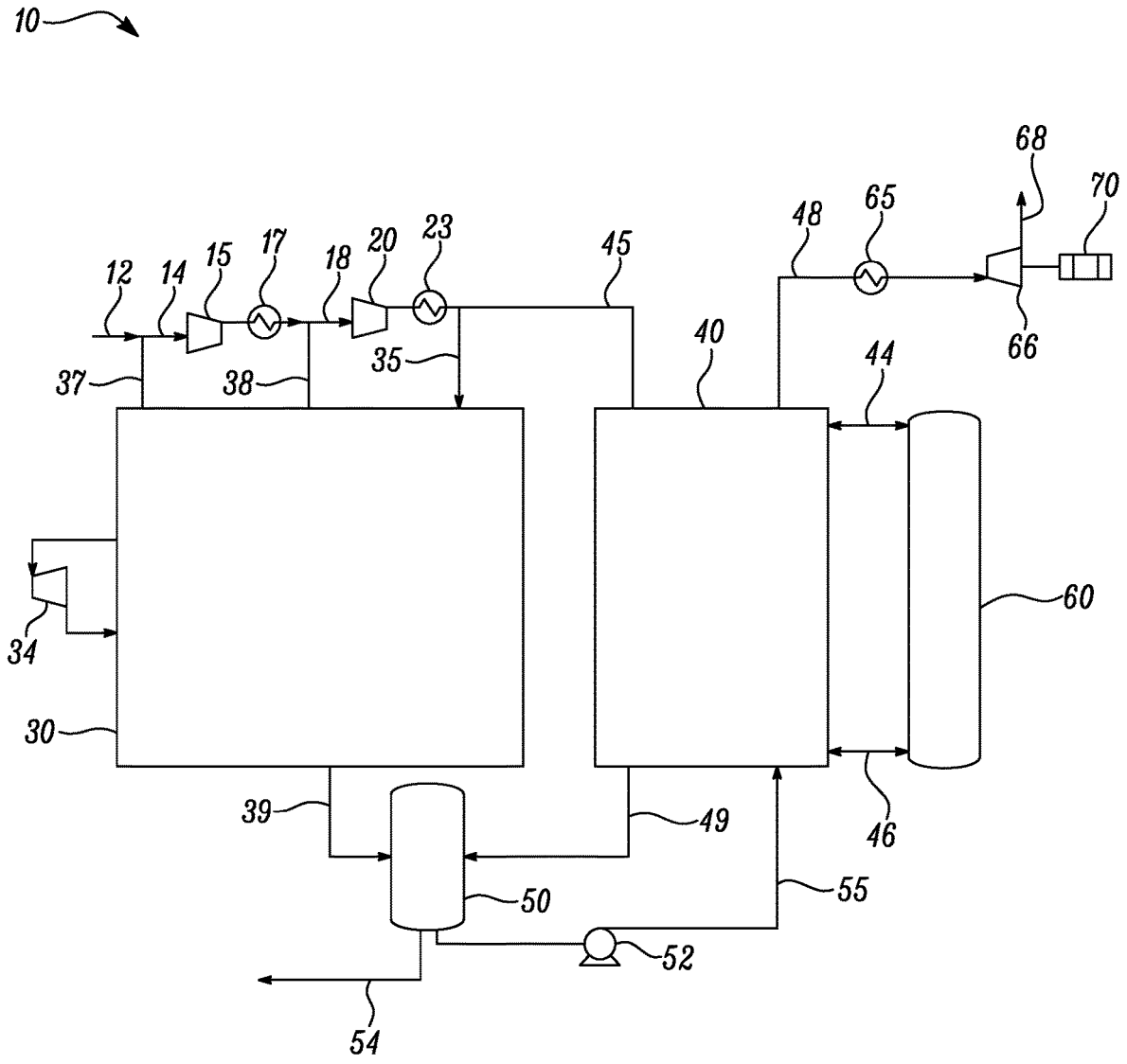
FIG. 1 is a schematic illustration of a generic liquid nitrogen energy storage system.

Turning now to FIG. 1, the illustrated LNES system 10 comprises a nitrogen liquefaction system, a cold recovery heat exchanger 40, a cold store 60, one or more liquid nitrogen tanks 50, a liquid nitrogen pump 52, a heat source 65 and a nitrogen power expander arrangement. Put another way, the LNES system can be characterized to include a commercial nitrogen liquefaction subsystem, a power generating subsystem, and a common liquid nitrogen storage subsystem.

The commercial nitrogen liquefier and related liquefaction equipment (e.g. compressors, aftercoolers, expanders, heat exchangers, etc.) typically include a feed compressor 15 configured to compress a gaseous nitrogen feed stream 12 and cooled in aftercooler 17. The compressed gaseous nitrogen stream 18 along with a nitrogen recycle stream 38 is then further compressed in recycle compressor 20 and cooled in aftercooler 23 to yield the gaseous nitrogen liquefaction stream. A first portion of the gaseous nitrogen liquefaction stream 35 is directed to the nitrogen liquefaction heat exchanger 30 where it is liquified using a reverse Brayton refrigeration cycle process involving the use of one or more turbo-expanders 34. The resulting streams include a liquid nitrogen stream 39 and one or more nitrogen recycle streams 37 and 38. The gaseous nitrogen feed stream 12 is typically sourced from a nearby air separation plant.

The nitrogen liquefaction system also typically includes one or more liquid nitrogen storage tanks 50 that are configured to receive and store liquid nitrogen 39 from the nitrogen liquefaction heat exchanger 30 and to release a liquid nitrogen product stream 54, as needed by local customers and the merchant liquid market in the area. Examples of various nitrogen liquefaction systems are shown and describes in U.S. Pat. Nos. 4,778,497; 5,231,835; and 6,220,053 and/or the liquefier configurations shown in FIGS. 2-5.

LNES systems may be installed at an existing nitrogen liquefaction system/plant as a retrofit application or as a new installation. Key to any implementation of LNES system is the need for both merchant liquid products and for energy storage. When applying the LNES system to existing liquefaction systems/plants, it is very important that the changes to operation of the equipment that are part of these operations are fully understood when LNES is added. In some cases, design changes to existing turboexpanders and compressors may be needed to best implement the addition of LNES systems. However, some of the LNES system configurations have the benefit of resulting in little or no change to the operation of existing liquefaction equipment which enables unconstrained, efficient operation with the equipment functioning in the LNES system configuration.

The illustrated LNES systems 10 shown in FIG. 1, is configured to operate in two distinct modes, including a liquid charging mode and a power generating mode. Energy storage systems such as LNES systems will always have at least two modes. In one mode electrical energy from its source, typically the electrical grid is stored in what is referred to as the liquid charging mode where liquid nitrogen is produced and stored in a liquid storage tank. During the preferred liquid charging modes the electricity is relatively low in cost. This corresponds to periods when electricity is abundant and costly generators are turned off. In the other mode energy is converted back to electricity and returned to its source, namely the electrical grid or it may be used simply to reduce our draw from the electrical grid. This is referred to as the power generating mode. During the power generating mode electricity is relatively expensive, such that higher cost generators must be turned on. In the LNES system, liquid nitrogen is vaporized (or pseudo-vaporized), heated, and expanded to generate electricity.

In the liquid charging mode, a second portion of the gaseous nitrogen liquefaction stream 45 is directed to a cold recovery heat exchanger 40 where it is liquified via indirect heat exchange with the refrigerant(s) 44, 46 from the cold store 60. The resulting auxiliary liquid nitrogen 49 from the cold recovery heat exchanger 40 is also directed to the liquid nitrogen storage tank(s) 50 for use, as needed, by local customers and the merchant liquid market in the area.

In the power generating mode, all or a portion of the liquid nitrogen 49 from the liquid nitrogen storage tank(s) 50 is pumped via pump 52 to a higher pressure to yield a liquid nitrogen energy stream 55. The liquid nitrogen 49 is preferably pumped to a pressure the range of about 500 psia to about 2000 psia.

The liquid nitrogen energy stream 55 is then fed to the cold end of the cold recovery heat exchanger 40 where the liquid nitrogen energy stream 55 is warmed via indirect heat exchange with the refrigerant(s) 44, 46 from the cold store 60 to yield a nitrogen energy stream 48. The cold recovery heat exchanger 40 will usually be a brazed aluminum heat exchanger (BAHX) which is widely used in the air separation industry, although other types of heat exchangers are possible (e.g., spiral wound stainless steel, brazed stainless steel).

The nitrogen energy stream 48 is further heated using a heat source 65 and the expanded in nitrogen expander 66 operatively coupled to a generator 70. The nitrogen expander 66 is configured to expand the further heated nitrogen energy stream to produce an exhaust stream 68 and the generator 70 is configured to convert the work of expansion into power. Ideally, the heat source 65 is a waste heat source. Waste heat considerably improves the electricity output of the nitrogen expander by raising its feed temperature. A potential waste heat source is the exhaust air from a gas peaker power generator with an outlet temperature typically about 900 degree Fahrenheit. In many embodiments, the nitrogen expander will consist of multiple expansion stages, with reheating of the nitrogen upstream of each expansion stage. In cases where waste heat sources are not available, the heat source may be the hot heat transfer fluid used to capture the heat of compression from the compressors used in the nitrogen liquefaction system.

The dedicated equipment for the LNES system 10 includes the cold recovery heat exchanger 40, the cold store 60, a liquid nitrogen pump 52, and the nitrogen power expander arrangement, which may include a heat source 65 configured to heat the warmed nitrogen stream 48 exiting the cold recovery heat exchanger 40, and a nitrogen expander 66 configured to expand the heated nitrogen stream and produce a nitrogen exhaust stream 68. The expander 66 is operatively coupled to a generator 70 to produce the power during the power generating mode. The exhaust stream 68 exiting the expander 66 may be vented or optionally recycled back to the gaseous nitrogen feed 12.

The warmed nitrogen stream 48 exiting the cold recovery heat exchanger 40 during the power generating mode is further heated using heat source 65 and the resulting stream is then expanded in nitrogen expander 66 which is coupled to generator 70. The illustrated LNES system 10 can effectively use waste heat from any co-located source as the heat source 65. As shown in FIG. 1, the heat source 65 preheats the nitrogen upstream of the nitrogen expander 66. If enough heat is available, multiple reheats can be performed. Use of this waste heat as the heat source 65 will increase the round trip efficiency of the LNES system 10. Potential waste heat sources are gas peaker exhaust streams, as well as waste heat from large power plants or industrial sources. So LNES system 10 provides a way of capturing waste heat that is otherwise lost and converting it to electricity. This is an additional green-house-gas (GHG) reduction feature of LNES system 10. Without waste heat capture the most efficient LNES system will capture waste heat from its own compressors to maximize round trip efficiency.

Because the nitrogen liquefier system and associated liquefaction equipment would typically already be installed where required to commercially produce a liquid nitrogen product, the liquid nitrogen pump 52, the cold recovery heat exchanger 40, the cold store 60 and the nitrogen power expander arrangement are the only additional expenses directly attributable to the liquid nitrogen energy storage (LNES) function.

The cold recovery heat exchanger 40 is preferably a brazed aluminum heat exchanger or BAHX which is widely used in the air separation industry. As indicated above, the cold recovery heat exchanger 40 is used to warm the pumped liquid nitrogen stream 55 to ambient temperature via indirect heat exchange with the cold store media during the power generating mode and is used to liquify a second portion of the further compressed gaseous nitrogen stream 45 via indirect heat exchange with the cold store media during the liquid charging mode.

The cold store 60 also serves a very important function for LNES system 10. The cold store is equipment containing media that captures the refrigeration of the liquid nitrogen stream 55 during the power generating mode so that it can be used to make the liquid charging mode more efficient. An effective cold store 60 can almost halve the power needed to generate the liquid nitrogen from the second portion of the further compressed gaseous nitrogen stream 45. There are at least two suitable cold store technologies that may be considered for use with the present liquid nitrogen energy storage system 10.

The first cold store technology uses flowing liquids that are used to capture the refrigeration from the warming pumped nitrogen during the power generating mode and then to return that refrigeration for the cooling high pressure nitrogen to produce additional liquid nitrogen during the liquid charging mode. Two different liquids are used; they are each passed from their respective warmer tank to their respective colder tank during the power generating mode and returned to their warmer tank during the liquid charging mode. Each liquid requires two tanks, so a total of four tanks are needed. The probable liquid choices are propane over the colder temperature range and ethanol or methanol over the warmer temperature range. Safe and environmentally sound storage and handling of these and similar liquids is widely done in the chemical and process industries. A more detailed description of a similar system can be found in U.S. patent application publication number 2015/0192330 A1, the disclosure which is incorporated by reference herein. Examples of liquid based cold store arrangements are detailed in FIGS. 2 and 3 and discussed below.

Figure 2:
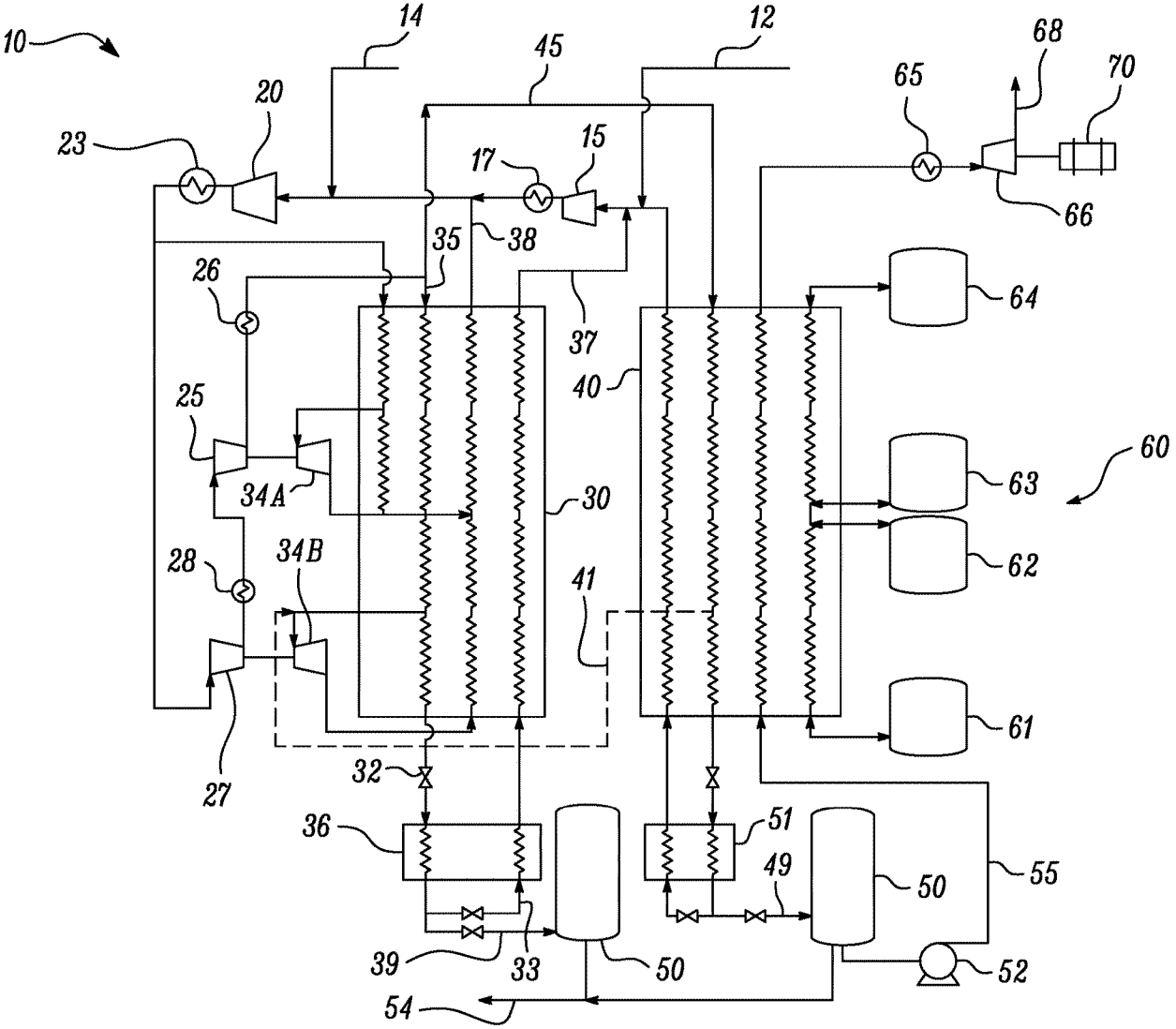
FIG. 2 is a schematic illustration of an embodiment of a liquid nitrogen energy storage system with a flowing liquid cold store arrangement.

Turning to the embodiment shown in FIG. 2, a low pressure gaseous nitrogen feed stream 12 is provided to the nitrogen liquefier from a nearby air separation unit. The low pressure gaseous nitrogen feed stream 12 is typically available at pressure between about 15 psia and 20 psia. Optionally, another gaseous nitrogen feed stream 14 can be provided from a medium pressure source at between about 70 psia to 90 psia. The high pressure liquid nitrogen exiting the liquefier heat exchanger is let down in pressure through a throttle valve 32 before it is subcooled in subcooler 36. Alternatively, a dense phase expander can be used to let down the pressure. However, given that the liquefier in a LNES system installation would usually operate during periods of relatively low cost power, the extra cost of the liquid expander will usually not justify the improved efficiency it provides. The liquid nitrogen is preferably subcooled against a throttled return stream 33 and subcooled stream 39 is then fed to a liquid nitrogen storage tank 50.

The nitrogen liquefier system depicted in FIG. 2 includes a feed gas compressor 15, a recycle compressor 20, a warm booster compressor 25, a cold booster compressor 27, aftercoolers 17,23, 26, 27, a warm turbine 34A and a cold turbine 34B. A second portion of the gaseous nitrogen from the liquefaction system is taken as a high pressure nitrogen stream 45 and directed to the cold recovery heat exchanger 40 where it is liquified via indirect heat exchange with the refrigerant(s) from the cold store 60 and directed to another liquid nitrogen storage tank 50. This auxiliary liquid nitrogen stream 49 is produced independently of the nitrogen liquefier and thus, the nitrogen liquefier operation is not greatly changed when LNES is implemented making this arrangement well suited for retrofit applications.

Due to the benefit of the cold store 60 the disclosed system and method is configured to produce liquid nitrogen at a significantly increased rate during the liquid charging mode. This necessarily means that the gaseous nitrogen feed rate will need to be increased. In most cases the nearby air separation unit has the capability of providing this increased gaseous nitrogen feed stream 12 rate, or an optional, medium pressure nitrogen feed stream 14 rate with the associated changes to the compression arrangements in the liquefaction system.

In the power generating mode the pumped liquid nitrogen stream 55 is warmed in the cold recovery heat exchanger 40 against the cold store refrigerants to about ambient temperature. While FIG. 2 shows the pumped liquid nitrogen stream 55 as a separate stream in a separate heat exchange passage in the cold recovery heat exchanger 40, it should be noted that it is generally undesirable to have unused passages in the cold recovery heat exchanger 40 in either mode. Thus, the pumped liquid nitrogen stream 55 could possibly use the same heat exchange passages as high pressure nitrogen stream 45 uses during the liquid charging mode.

During the power generating mode, the cold store refrigerants are flowing liquids that flow in a counter current direction to warm the pumped liquid nitrogen stream 55 while they cool. In this way the cold store refrigerants capture the refrigeration, or cold, of the warming pumped nitrogen stream 55. During the liquid charging mode, they flow in the opposite direction through the same passages of the cold recovery heat exchanger 40 and the cold store refrigerants warm back to their former temperature, and the refrigeration that they release enables liquid nitrogen production from the cold recovery heat exchanger 40 and subcooler 51.

In the illustrated embodiment, four (4) separate cold store vessels configures as liquid refrigerant tanks 61, 62, 63, 64 are required for the two cold store refrigerants, including at least two (2) liquid tanks for each liquid refrigerant. Pumps (not shown) are required to motivate the cold store refrigerants through the cold recovery heat exchanger 40 and into or from their respective liquid tanks. The pumps counteract the system pressure drop and elevation head (as the cold recovery heat exchanger 40 are usually disposed in a vertical orientation). The most likely selection for the first cold store refrigerant is propane while ethanol or methanol is the preferred second cold store refrigerant. A more complete list of possible cold store liquid refrigerants can be found in U.S. patent publication number 2015/0192330A1.

The first cold store refrigerant 46 is the colder refrigerant and flows from tank 61 to tank 62 during the liquid charging mode and flows from tank 62 to tank 61 during the power generation mode. The temperature of the first cold store refrigerant cycles to a range of 95 Kelvin and 110 Kelvin at the cold end and in tank 61 to to a range of 160 Kelvin and 220 Kelvin at the intermediate location and near tank 62. Similarly, the second cold store refrigerant 44 is the warmer refrigerant and flows from tank 63 to tank 64 during the liquid charging mode and flows in the opposite direction from tank 64 to tank 63 during the power generation mode. The temperature of second cold store refrigerant cycles is about ambient temperature at the warm end and in tank 64 to to a range of 160 Kelvin and 220 Kelvin at the intermediate location and near tank 63.

Although not shown, it is possible to include a third tank for the first cold store refrigerant such that the first cold store refrigerant is withdrawn and returned to the cold recovery heat exchanger at two levels. This enables the temperature profiles of the warming pumped nitrogen during the power generating mode and the cooling high pressure nitrogen stream during the liquid charging mode to be better matched.

In the illustrated embodiments, the high pressure nitrogen feed stream pressure will typically be within a range of about 600 psia and 1000 psia while the pumped liquid nitrogen pressure will be between about 500 psia and 2000 psia. As is the case for a nitrogen liquefier, it is highly desirable that the pressure of both streams is higher than the critical pressure of nitrogen (i.e. about 490 psia). This makes the temperature profile of the heat exchanger smoother, generally reducing power consumption. Also, when the pumped nitrogen pressure is higher, the power generated will be greater. However, if the pumped nitrogen pressure is significantly greater than the nitrogen feed stream there is more of a mismatch in the cooling and warming temperature and duty requirements in the cold recovery heat exchanger that need to be provided by the cold store refrigerants.

For example, higher nitrogen pumped pressures mean less duty is required to warm the resulting nitrogen energy stream to ambient temperature, and less refrigeration is captured during the power generating mode. This means that during the liquid charging mode the cooled nitrogen exiting the cold recovery heat exchanger tends to become less cold. Now the flash gas return stream rate becomes larger to make liquid product from the subcooler at an appropriately low temperature such that flash-off losses in the feed to the liquid nitrogen storage tank(s) are not large. The result is higher power consumption by the nitrogen feed gas compressor and recycle compressors(s). To mitigate this problem, the optional take-off stream 41 may be used. The take-off stream 41 is withdrawn from the high pressure stream at an intermediate temperature, typically at a range of 150 Kelvin and 200 Kelvin and fed to the inlet of the cold turbine 34B in the nitrogen liquefaction system, where it is combined with the feed stream to the cold turbine.

By withdrawing this take-off stream 41, the cooling temperature profile of the high pressure stream 45 is changed, and the duty required to cool it is reduced. The result is the cooled nitrogen exiting the cold recovery heat exchanger can now be colder and the flash gas return stream rate is reduced. The liquid product rate from the cold recovery heat exchanger and subcooler is reduced, but the liquid product rate from the nitrogen liquefier is increased.

While it is most economical to send stream 41 upstream of cold turbine 34B, there may be instances when this will lead to inefficient operation of the cold turbine 34B, or the turbine operating constraints may otherwise limit operation. In that case, addition of another turbine may be warranted to expand stream 41 with the exhaust of the additional turbine combined with the exhaust of the cold turbine.

Figure 3:
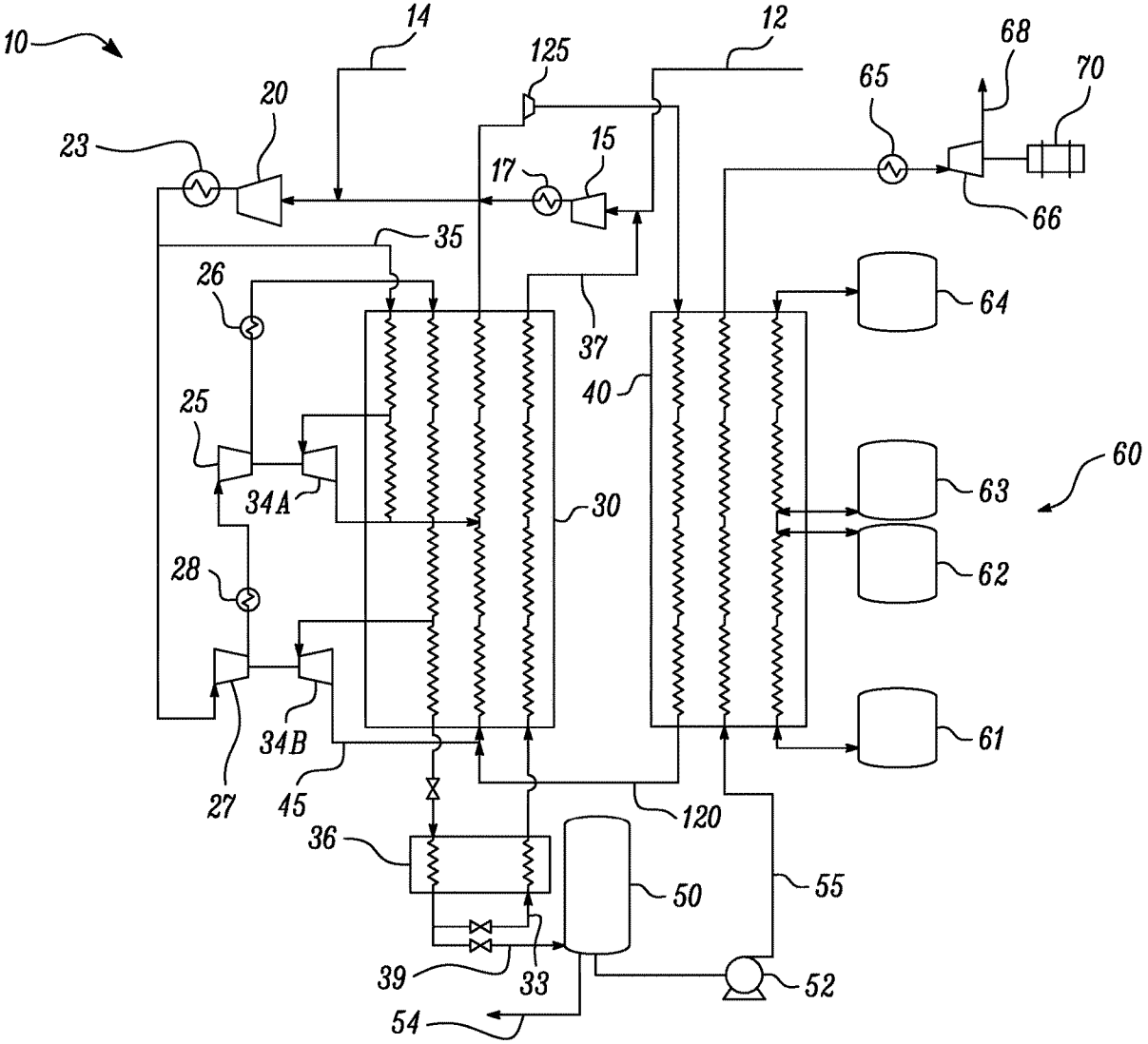
FIG. 3 is a schematic illustration of another embodiment of a liquid nitrogen energy storage system with a flowing liquid cold store arrangement.

It is also contemplated to configure the cold recovery heat exchanger to deliver a cold nitrogen gas 120 at the cold end of the cold store heat exchanger 40 rather than the auxiliary liquid nitrogen during the liquid charging mode, as depicted in FIG. 3. The cold nitrogen gas 120 exiting the cold recovery heat exchanger 40 would be recycled to the nitrogen liquefaction heat exchanger 30 to capture its refrigeration and recirculated with a recirculating blower 125. Such arrangement avoids the potential efficiency penalty that may occur when liquid nitrogen from the cold store heat exchanger 40 is less cold than ideal, which will result in high flash gas flows to produce subcooled liquid nitrogen product.

The second cold store technology uses a solid media. Here a cold store vessel or series of cold store vessels containing solid media (e.g. limestone gravel) provides the capacitance to capture and store refrigeration during the power generating mode and to return the refrigeration during the liquid charging mode. A recirculating nitrogen gas flow is needed to transfer the refrigeration from and to the cold recovery heat exchanger, depending on the mode. The recirculating flow direction changes between the modes. Unlike the flowing liquid cold store, the solid media cold store completes each mode with a temperature profile over its length. The cold end must remain at about a constant temperature so the liquid charging mode can be efficient for its entire duration, and the warm end must remain at about a constant temperature so the power generating mode can be efficient for its entire duration. This is key to the proper sizing of the solid media based cold store arrangement.

Figure 4:
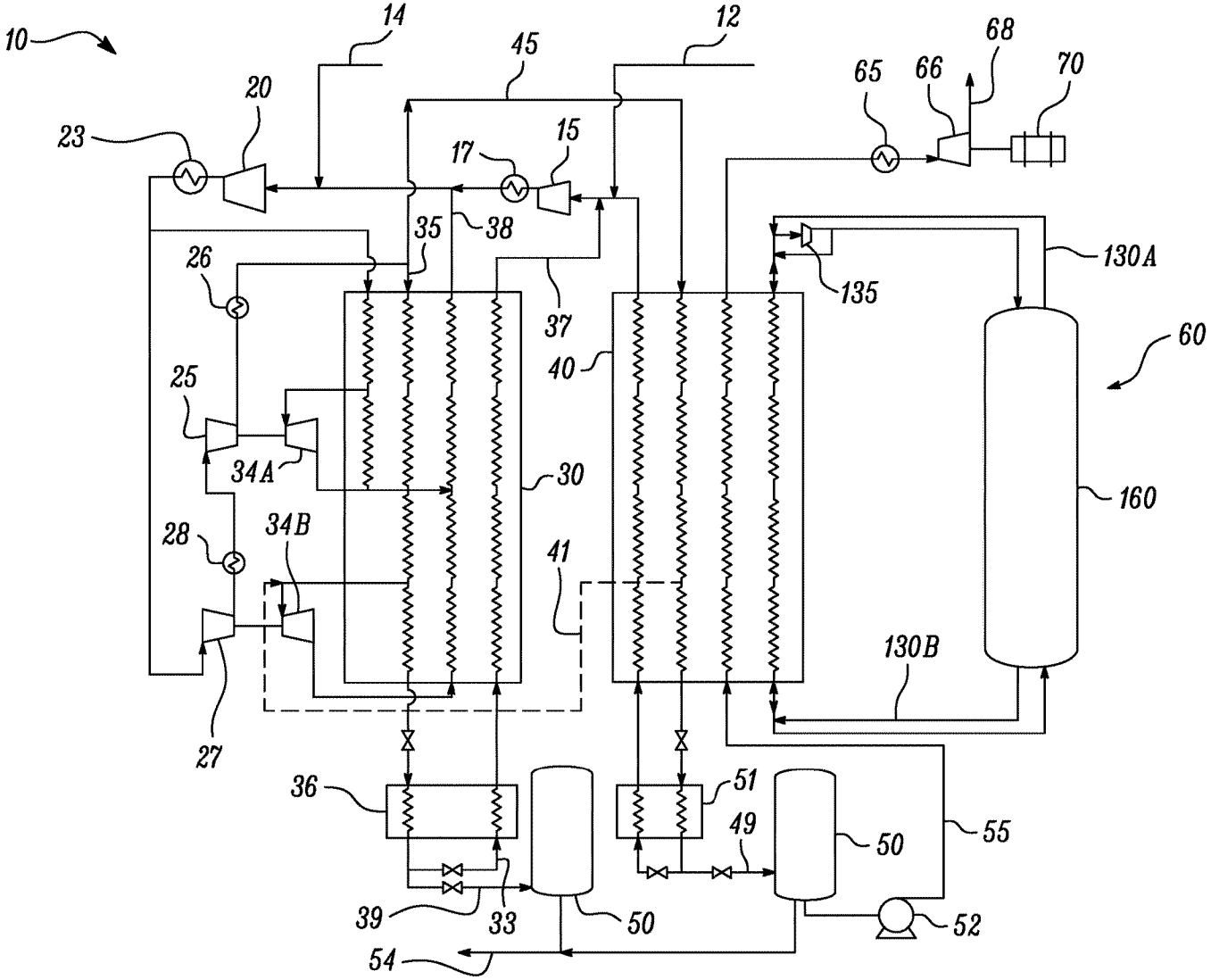
FIG. 4 is a schematic illustration of an embodiment of a liquid nitrogen energy storage system with a solid media cold store arrangement.

The embodiment illustrated in FIG. 4 uses a solid media cold store. Here the cold store 60 arrangement uses a solid material that cools a recirculating gas stream 130A during the power generating mode where it absorbs refrigeration from the warming of the pumped liquid nitrogen stream 55 and warms the recirculating gas stream 130B during the liquid charging mode where it provides refrigeration for the cooling high pressure nitrogen stream 45. Unlike the flowing liquid cold store, the solid media cold store arrangement maintains a set temperature profile during its operation. It is important that the solid media cold store 60 is sized so that the recirculating fluid exiting the cold end does not warm much over the entire liquid charging mode duration, nor does the recirculating fluid exiting the warm end cool much over the entire power generating mode duration.

The solid media is most likely loose filled material such as limestone gravel. A higher heat capacity material such as taconite (i.e. iron ore pellets) may be an attractive alternative. The solid media cold store 60 is likely to use multiple cold store vessels arranged in series and/or ganged in a parallel arrangement. The solid media cold store 60 uses a recirculating gaseous stream 130 directed through the cold store vessel 160 to transfer heat to and from the solid media. The solid media based cold store vessel(s) 160 are typically large in size and preferable constructed with cryogenic compatible metals such as stainless steel or aluminum.

A recirculating blower 135 moves the recirculating gas through the cold store system and the cold recovery heat exchanger in the direction shown depending on the operating mode selected. Although not shown, the pumped liquid nitrogen may use the same heat exchange passages in the cold recovery heat exchanger as high pressure nitrogen. The recirculating gas will have discrete layers in the heat exchanger. It may also use the same passages as the flash gas during the power generating mode.

In addition to the parasitic loss for the recirculating blower, the solid media cold store arrangement will tend to be less efficient than the flowing liquid cold store arrangements because of less efficient recovery of refrigeration. The recirculating gas flow has a nearly constant heat capacity over its temperature range. Meanwhile the warming high pressure pumped nitrogen in the power generating mode and the cooling high pressure nitrogen in the liquid charging mode exhibit widely varying heat capacities over their temperature ranges. Hence, the temperature profile during each operating mode show large temperature differences, which penalizes the overall refrigeration recovery.

Figure 5:
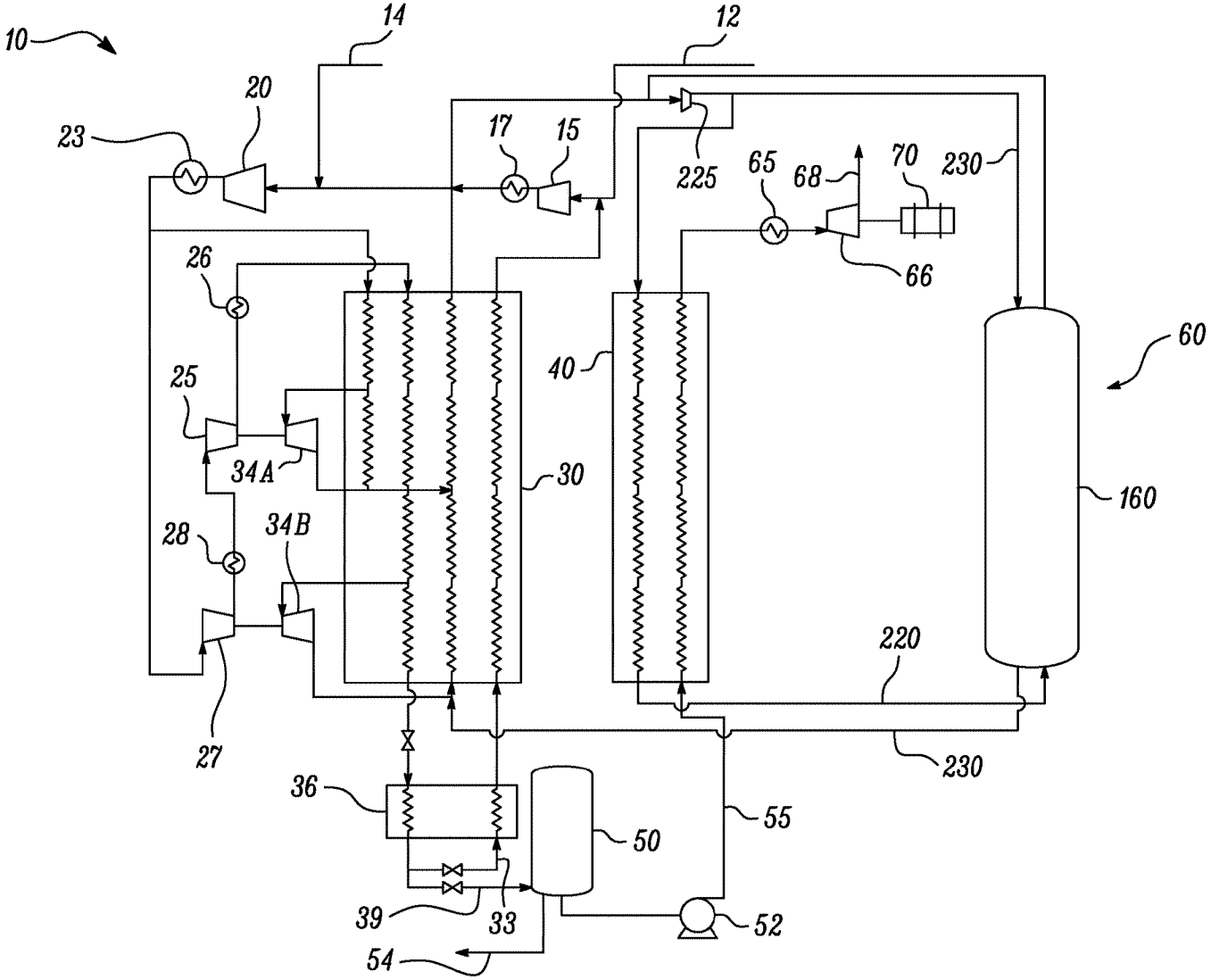
FIG. 5 is a schematic illustration of another embodiment of a liquid nitrogen energy storage system with a solid media cold store arrangement.

Similar to the liquid flowing cold store arrangements shown and described with reference to FIG. 3, it is also contemplated to configure the solid media based cold store arrangements to also deliver a cold nitrogen gas 220 rather than the auxiliary liquid nitrogen during the liquid charging mode, as depicted in FIG. 5. During the power generating mode, the cold nitrogen gas 220 exiting the cold recovery heat exchanger would be recycled through the cold store 60 to capture its refrigeration and then recirculated through the cold recovery heat exchanger 60 with a recirculating blower 225. In this embodiment, the cold recovery heat exchanger 60 is only in use during the power generating mode. During the liquid charging mode, a recirculating nitrogen stream 230 would be recirculated from the liquefaction heat exchanger 30 through the cold store 60 with the recirculating blower 225.

Higher pressure operation will reduce power consumption but will tend to increase the cost of the solid media cold store vessels due to the need for thicker walls. In this embodiment, the recirculating nitrogen stream 230 uses a common passage with the cold turbine 34B exhaust stream and warm turbine 34A exhaust stream, setting its pressure for the liquid charging mode. Alternatively, the recirculating nitrogen stream 230 could be combine with the low pressure flash gas from the subcooler 36 during liquid charging mode to operate at a lower pressure.

Also, the recirculating blower 225 must operate in both liquid charging mode and power generating mode, although the recirculating blower 225 may be operated at different pressures during the different operating modes. This is unlike the flowing liquids as the cold store where the recirculating blower only operates in the liquid charging mode.

The embodiments of the LNES system illustrated in the drawings are designed to minimize or eliminate the modifications needed to an existing nitrogen liquefier systems, yet still achieve good round trip efficiency. There are probably hundreds of nitrogen liquefiers in the United States with many of them operated significantly below their full capacity. These nitrogen liquefiers are commonly turned on and off to take advantage of low time of use power rates. So, they not only have extra available capacity to facilitate the addition of energy storage production, they also have demonstrated the robustness to handle the on-off operation that is part of LNES system. It is also desirable to avoid the cost of an additional or dedicated liquid storage tank(s) typically associated with LASS systems. In many cases there is excess liquid nitrogen storage capacity at existing nitrogen liquefiers that can be utilized so that additional liquid nitrogen storage tank(s) can be avoided.

The illustrated embodiments of the LNES systems use conventional equipment for nitrogen liquefaction and for power generation. However, given that the long duration energy storage market is nascent, and given that implementation of even well-known equipment in a new configuration leads to significant capital cost uncertainty, the illustrated LNES systems may provide an essential bridge to commercialization. The probable best economic range for the present LNES system in future commercial opportunities is a magnitude of at a range of 10 MW and 100 MW, with a generation duration a range of about 8 hours and 20 hours.

While the present system and method has been described with reference to certain embodiments, various changes may be made without departing from the spirit and the scope of the disclosure, which is defined, not by the detailed description and embodiments, but by the appended claims and their equivalents.

What is claimed is:

1. A method of producing power and a liquid nitrogen product with a liquid nitrogen energy storage system comprising the steps of:

(i) providing a gaseous nitrogen feed stream to the liquid nitrogen energy storage system;

(ii) liquefying a first portion of the gaseous feed nitrogen stream in a nitrogen liquefier configured to produce a liquid nitrogen;

(iii) directing the liquid nitrogen to one or more liquid nitrogen storage tanks;

(iv) cooling a second portion of the gaseous nitrogen feed stream in a cold recovery heat exchanger via indirect heat exchange with one or more cold store refrigerants to yield a cold nitrogen stream while operating the liquid nitrogen energy storage system in a liquid charging mode;

(v) directing a portion of the liquid nitrogen from the one or more liquid nitrogen storage tanks to the cold recovery heat exchanger as a liquid nitrogen energy stream;

(vi) warming the liquid nitrogen energy stream in the cold recovery heat exchanger via indirect heat exchange with the one or more cold store refrigerants to yield a nitrogen energy stream while operating the liquid nitrogen energy storage system in a power generating mode; and (vii) expanding the nitrogen energy stream in a nitrogen expander and converting the work from the expansion of the nitrogen energy stream into power;

(viii) optionally withdrawing a liquid nitrogen product stream; and (ix) wherein the liquid nitrogen energy storage system switches between operating in the liquid charging mode and operating in the power generating mode.

2. The method of claim 1 wherein the cold nitrogen stream is another liquid nitrogen stream that is directed to the one or more liquid nitrogen storage tanks when operating the liquid nitrogen energy storage system in the liquid charging mode.

3. The method of claim 1 wherein the cold nitrogen stream is a cold gas stream that is recirculated through a liquefaction heat exchanger and the cold recovery heat exchanger using a recirculating blower when operating the liquid nitrogen energy storage system in the liquid charging mode.

4. The method of claim 1 further comprising the step of further heating the nitrogen energy stream using a heat source after the step of warming the liquid nitrogen energy stream in the cold recovery heat exchanger and prior to the step of expanding the nitrogen energy stream.

5. The method of claim 1 wherein the one or more cold store refrigerants are stored in one or more cold store vessels disposed in flow communication with one or more heat exchange passages in the cold recovery heat exchanger.

6. The method of claim 1 wherein the one or more cold store refrigerants comprise a cold store solid media.

* * * * *